United States Patent [19]

Beierle et al.

[11] 4,030,704

[45] June 21, 1977

[54] WIRE OR CABLE REEL SUPPORT

[76] Inventors: Carl Beierle, 12613 Brooklake St., Los Angeles, Calif. 90066; Harry Irik, 2025 Ashland Ave., Santa Monica, Calif. 90405

[22] Filed: July 25, 1975

[21] Appl. No.: 599,045

[52] U.S. Cl. ..... 254/139.1; 214/DIG. 4; 242/85; 248/168

[51] Int. Cl.[2] ..... B66C 23/60

[58] Field of Search ..... 254/139, 139.1, 144, 254/145, 142; 214/77 R, 130 C, DIG. 3, DIG. 4; 242/85; 52/122; 248/168, 170

[56] References Cited

UNITED STATES PATENTS

| | | | |
|---|---|---|---|
| 1,030,763 | 6/1912 | Bean | 254/139.1 |
| 1,121,807 | 12/1914 | Dearborn | 214/DIG. 4 |
| 1,204,470 | 11/1916 | Miller | 254/144 |
| 1,895,217 | 1/1933 | Van Vorst | 214/DIG. 4 |
| 2,179,825 | 11/1939 | Lewis | 214/DIG. 4 |
| 2,309,769 | 2/1943 | Hubbard | 254/139 |
| 2,341,350 | 2/1944 | Young, Sr. | 214/DIG. 4 |
| 2,491,967 | 12/1949 | Ghant | 214/DIG. 4 |
| 2,525,346 | 10/1950 | Gilbert | 214/DIG. 4 |
| 2,624,476 | 1/1953 | Schmidt | 214/77 R |
| 2,678,790 | 5/1954 | Egger | 248/168 |
| 2,779,648 | 1/1957 | Kranz | 248/168 |
| 3,408,781 | 11/1968 | Pollock | 52/122 |
| 3,520,514 | 7/1970 | Evans | 254/139 |

*Primary Examiner*—L. J. Paperner
*Assistant Examiner*—Kenneth Noland
*Attorney, Agent, or Firm*—Mahoney, Schick & Cislo

[57] ABSTRACT

A lifting and support system for heavy reels of wire or cable, wherein the apparatus utilized for obtaining positioning of the reel for easy unwinding or uncoiling of wire or cable that is wound on said reel, is rugged in construction, simple to use, and of low manufacturing cost. The system involves the placement, of an axle, shaft or horizontal support, which may be one continuous length or two shorter lengths, positioned through or on the lateral sides of the reel to provide means whereby, through a simplified hoist mechanism, one side of the reel may be lifted off the ground or floor surface at a time. Once one side of the reel is in elevated position, the hoist mechanism permits pivotal or arcuate movement of the reel so as to position the reel for subsequent wire or cable pulling. Once one end of the reel has been elevated, a simplified support structure is placed thereunder, which support structure is collapsible and easily transportable requiring no tools to put it in the erected, reel supporting state. Once the support member is positioned on the elevated side of the reel, the hoist mechanism is removed and positioned on the opposite side of the reel to elevate same to the level of the opposite, elevated side. Once elevated this other side of the reel has positioned beneath the support member, a like support means as positioned on the already other, elevated side of the reel. Once the second support member is positioned, the hoist may be removed and the reel is now in elevated position for easy unwinding of the stored wire or cable on the drum of the reel.

16 Claims, 12 Drawing Figures

WIRE OR CABLE REEL SUPPORT

BACKGROUND OF THE INVENTION

This invention relates to cable or wire reel hoist lifting and support mechanisms for supporting a reel of cable or wire from which the cable or wire is to be unwound and is of the type normally employed by electrical contractors or other workers in stringing wire or cable ubiquitously found in, for example, commercial, residential or industrial type buildings.

At present, heavy electrical wire or cable is wound on large reels which have a center opening therethrough to receive sophisticated lifting and support mechanisms for supporting the reel for rotation so that the wire or cable may be unwound therefrom during the wire or cable stringing or pulling operation.

The prior art devices heretofore suggested for supporting cable or wire reels for easy rotation and unwinding of cable or wire therefrom, have either involved jack-type mechanisms, inclined planes or similar type devices which have been difficult to use or were quite costly to manufacture, and in some instances, induced safety hazards which would redound to the detriment of electrical workers working with the supported reel.

The prior art devices have also taken up a considerable amount of space requiring not only space for transportation to and from the job site, but also storage space in the electrical contractor's warehouse between jobs, not to mention the space taken up in supporting the reel for rotative movement where close, on-the-job quarters are involved, such as, for example, as may be found in electrical vaults or the like. The device of this invention is easily disassembled, is easily carried and is easily erectable to adequately support cable or wire reels in an economical, easy and safe manner.

OBJECTS AND SUMMARY OF THE INVENTION

The present invention provides a reel hoisting and support system wherein use is made of the central aperture passing through the hub of the reel and terminating in the opposed circular ends making up the standard cable or wire reel wherein an elongate support member is positioned therethrough, or other shorter members are positioned in the central aperture or bore, to provide means whereby one end of the reel may be lifted at a time. The hoist mechanism of the invention, employs a rugged, simplified, almost fault-free, winch means supported on a standard having at the upper portion thereof a roll bar or pivotal projection, so that once the one end of the reel has been hoisted or elevated above the ground or floor surface, the reel may be pivoted or moved through a planar arc to properly position the reel for unwinding of the cable or wire therefrom. Once the reel has been properly positioned and one end of the reel is elevated, a support member is positioned therebelow and comprises a duo-pod configuration which serves to support the elevated side of the reel. The hoist mechanism is then positioned on the opposite side of the reel and similarly put in elevated position, while an identical duo-pod support member is positioned thereat, so as to obtain total elevation of the reel for unwinding of the cable or wire therefrom.

It is an object of the present invention to provide a lifting and support system for heavy reels upon which is wound cable or wire.

It is another object of the present invention to provide a lifting and support system for reels wherein the reel may be easily positioned for off feeding of the wire or cable therefrom.

It is another further object of the invention to provide a simplified, lifting mechanism for elevating reels which permits easy pivotal movement of the reel.

It is still a further object of the invention to provide a lifting and support system for heavy cable or wire reels wherein the support members making up the system are easily carried and easy to manipulate to be put into the erected reel-supporting position.

It is still another further object of the invention to provide an identical pair of support members making up a reel lifting and support system wherein the support members are collapsible for ease of storage and transportation and are of duo-pod configuration and which are of low cost to manufacture and to maintain.

It is still another further, important, object of the invention to provide a cable or wire reel lifting and support system and a method for same, wherein heavy cable or wire reels are easily and safely lifted into supported relationship with a pair of duo-pod members, positioned on either side of the reel, to permit easy uncoiling of the stored wire or cable from the elevated reel.

In an exemplary embodiment, the invention is directed to a reel support for elevatingly, supporting a central bore reel of cable or wire and to permit the unwinding of cable or wire therefrom comprising means for sequentially lifting one end of the reel at a time for placement of a support member on each side thereof employing a support means adapted for use in lifting and supporting each side of the reel and adapted for cooperative association with the reel. A pair of support members is utilized for positioning on each side of the reel and are adapted to be cooperatively and supportingly associated with the support means wherein said pair of support members each comprise a mounting member to receive the support means in supportive, mountive relationship, a first elongate, leg member fixedly secured to said mounting member and a second, spaced, elongate leg member pivotly secured to said first mounting member. Retaining means is cooperatively associated with the support members for selectively positioning and retaining the second elongate leg member with respect to the said first elongate leg member whereby said pair of support members support said reel in stable elevation to permit rotation thereof.

These and further objects will become apparent from the hereinafter following commentary when making particular reference to the figures of drawings and as set forth in the appended claims.

DESCRIPTION OF THE BEST EMBODIMENTS CONTEMPLATED

Figure 1:
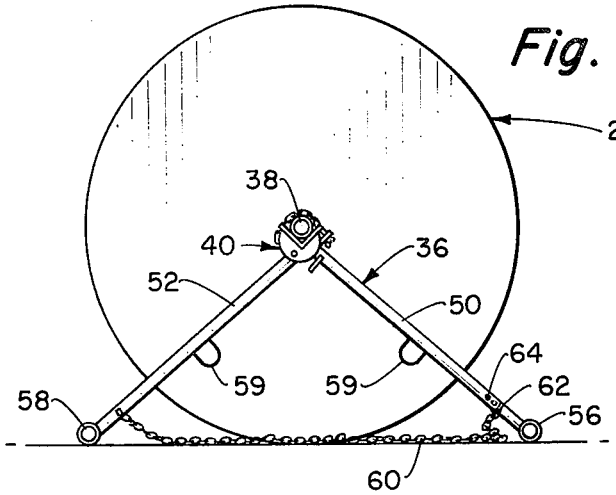
FIG. 1 illustrates a cable or wire reel resting on the ground or other surface with the support device of the invention in place and ready to be erected.

Referring to the figures of drawings wherein like numerals of reference designate like elements throughout, it will be seen that a reel 2 of the type usually utilized for storing lengths of wire or cable has circular ends 4 and 6 with a central drum or hub structure (not shown) having a central bore 7 terminating through circular ends 4 and 6. Wire or cable 8 is wound in multilayers upon the drum and it is necessary to elevate and support the reel 2 so that the wire or cable 8 may be easily taken off the drum by means of rotation of the reel 2.

Reels such as 2 of copper wire or cable may weigh many thousands of pounds and at best are difficult to handle or move. With the lifting and support system of the herein disclosed invention, generally designated 10, heavy reels are easily positioned and erected so that cable or wire 8 may be freely played therefrom. The lifting and support system 10 comprises lifting mechanism 12 employing the conventional winch component 14 supported on an A-frame member 16 having opposed legs 18 and bottom tie bar 20. The winch mechanism 14 employs the usual handle 22 operatively connected to gear 24 which employs drum 26 on which cable 28 is wound thereon. Rotation of the handle 22 rotates gear 30 which in turn rotates gear 24 to either wind or unwind the cable 28. Biased dog member 32 is provided so as to have positive control over the drum 26 and hence the unwinding or winding of cable 28 once load is applied to the end of cable 28 which terminates in loop 34. Roll bar 15, offset from winch 14, is secured to each of legs 18 by bolts, weld joints or other means.

Figure 4:
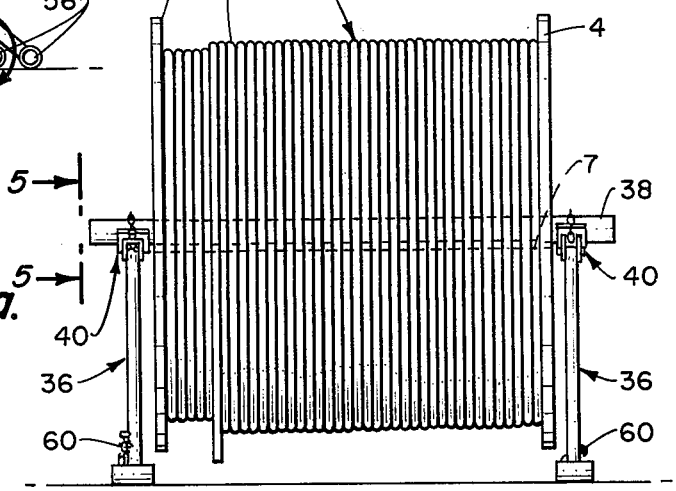
FIG. 4 is a front view illustrating the cable or wire reel in the elevated position ready for unwinding of cable or wire therefrom.

The duo-pod support members 36, which are identical in configuration and structure, are eventually positioned on each side of reel 2 as seen in FIGS. 1 and 4. A length of pipe 38 may be positioned through the drum of reel 2 through the circular ends 4 and 6 so as to provide a means whereby reel 2 may be lifted and supported. In lieu of a straight length of pipe or other horizontal support member, shorter lengths of pipe or bars for example may be utilized, which do not extend throughout the entire length of the bore through the hub of reel 2. For practical purposes, however, a single length of pipe 38 has been found to be a preferred form because of the annular bore or hole normally found in cable or wire reel 2.

The duo-pod support members comprising the lifting and support system 10 comprise a mounting member 40, here shown as a V block support, of sufficient width to receive a sufficient length of horizontal support or pipe 38. The mounting member 40 comprises a pair of spaced circular iron plates 42 and 44 which have been notched or cut as at 46 to receive V plate 48 which is welded or otherwise secured to the spaced plates 42 and 44. Between the plates 42 and 44 and spaced below V plate 48 is U-shaped retainer 47 for purposes to be described. Between plates 42 and 44 is fixedly secured elongate leg 50, by means of welding or otherwise, the length of which is sufficient to eventually position the reel 2 in elevated position off the ground or floor surface. Spaced from elongate leg 50 is second elongate leg member 52 which is pivotly secured as at 54 to spaced plates 42 and 44. Legs 50 and 52 are illustrated as being tubular pipe having termini that comprise similar short sections of pipe 56 and 58 welded to the ends of legs 50 and 52 respectively, so as to provide suitable distribution of weight, to prevent floor marring, to obtain a level plane and otherwise to prevent the legs 50 and 52 from damaging the floor surface or sinking into the ground under the tremendous weight of reel 2. Obviously, other termini may be utilized taking the configuration of feet or pads, also employing universal joints, to obtain additional leveling where same would be required.

Figure 3:
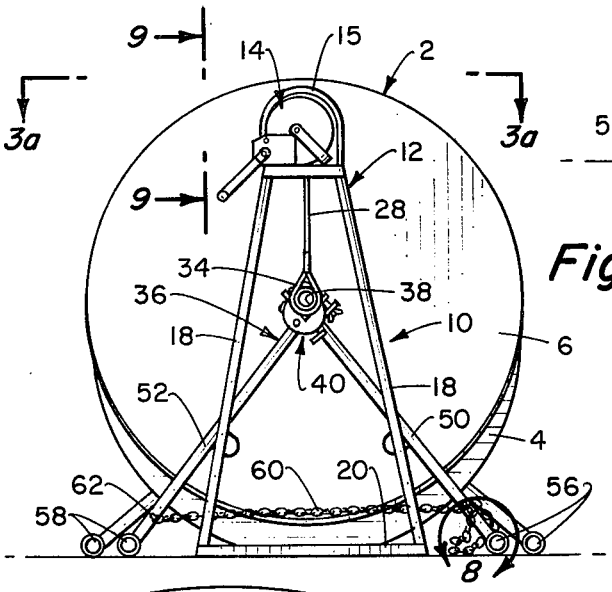
FIG. 3 illustrates the reel of FIGS. 1 and 2 having one end elevated and the erection of the support member of the system in the elevatingly supportive position.
Figure 3A:
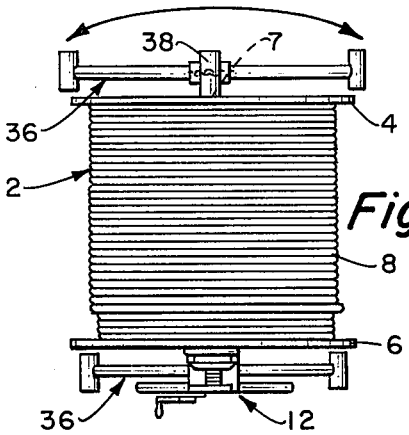
FIG. 3*a* is a view taken along the line 3*a*—3*a* of FIG. 2.

Midway between the ends of legs 50 and 52 are positioned welded handles 59 which provide ease of carrying of the duo-pod support member with a retaining means, such as length of chain 60, secured by suitable hasps 62 to the bottom portions of legs 50 and 52. It will be noted that the length of chain 60 is slack in the unerected state, as shown in FIG. 1. Spaced from the foot 56 of leg 50 is a pair of locking fingers 64 that provide means of taking up the slack of chain 60 once the duo-pod structure has been erected as illustrated in FIGS. 3 and 4 of the drawings. The chain 60 is frictionally retained by locking fingers 64 and is easily put into the locked or unlocked position for ease of erecting and disassembly of the supporting duo-pod support members.

Figure 5:
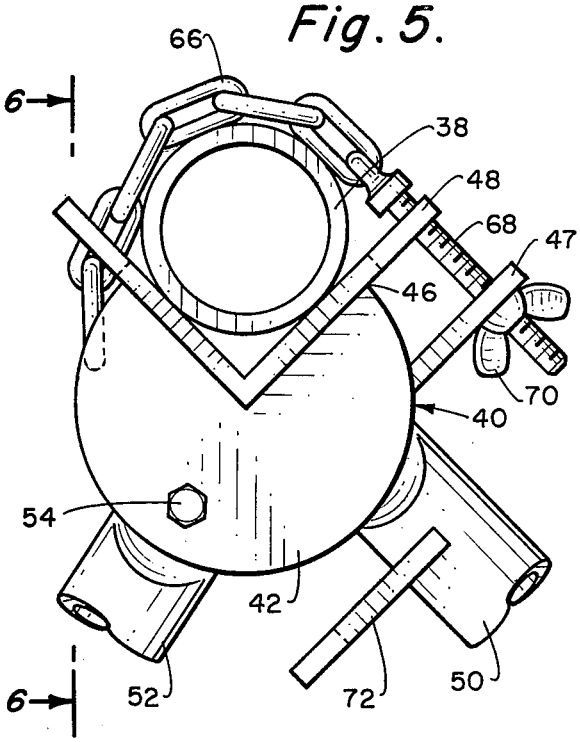
FIG. 5 is a view taken along the line 5—5 of FIG. 4.
Figure 6:
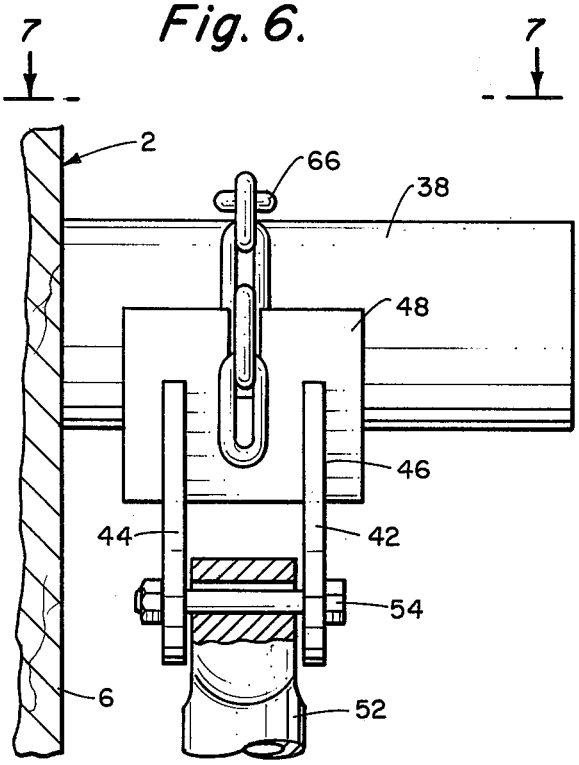
FIG. 6 is a view taken along the line 6—6 of FIG. 5.
Figure 7:
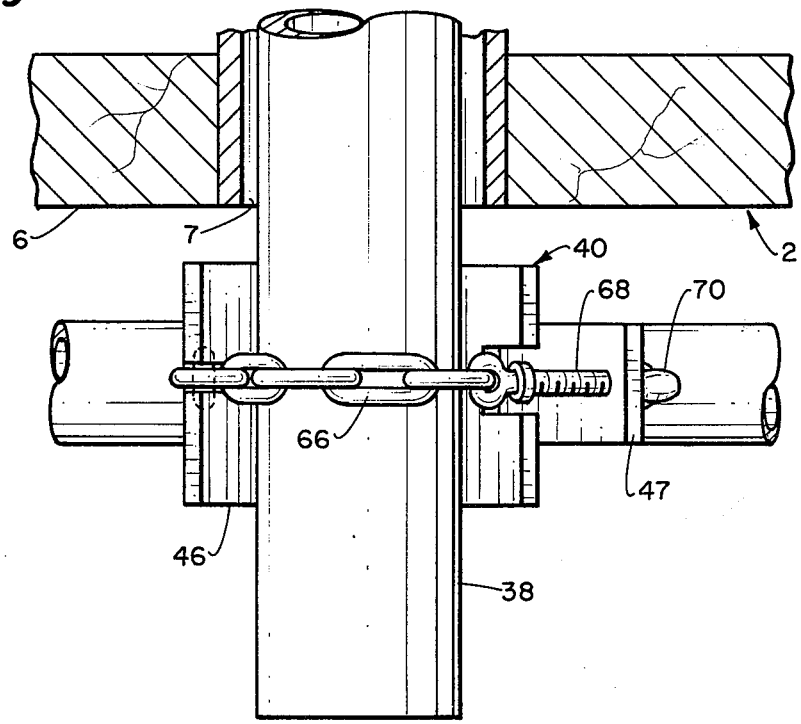
FIG. 7 is a view taken along the line 7—7 of FIG. 6.
Figure 8:
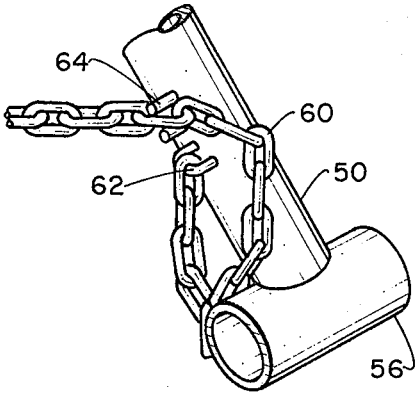
FIG. 8 is a fragmentary view of the terminus of one of the leg members making up the duo-pod support of this invention.

Referring to FIGS. 5, 6 and 7, more detailed construction of mounting member 40 is illustrated. Welded midpoint of the V plate 48 is a length of chain 66 terminating in a bolt 68, adapted to pass through retainer 47, to which may be affixed wing screw 70. Once the horizontal support pipe, for example 38, has been positioned through the reel 2, the locking chain 66 is engaged as shown in FIG. 5 and securely and rigidly retains the end of pipe 38 in secured, clamped fashion. Where desired a chain stowing pin 72 may be provided on the upper portion of leg 50 so as to provide means of easily wrapping the chain 60 for transport of the duo-pod support members of the invention.

Referring now to FIGS. 1, 2, 3, 3*a*, and 4, the method of utilizing the aforedescribed apparatus will be described. Reel 2 is resting on the ground or other floor surface and has placed on either side thereof the duo-pod support members 36, with the support pipe or other support member 38, projecting outwardly from the reel 2. The chain lock 66 is positioned to firmly secure the support pipe 38 through the V support block 48 with the legs 50 and 52 of the duo-pod support members 36 essentially in the position shown in FIG. 1. (Support members 36 may be positioned after end elevation.)

Figure 2:
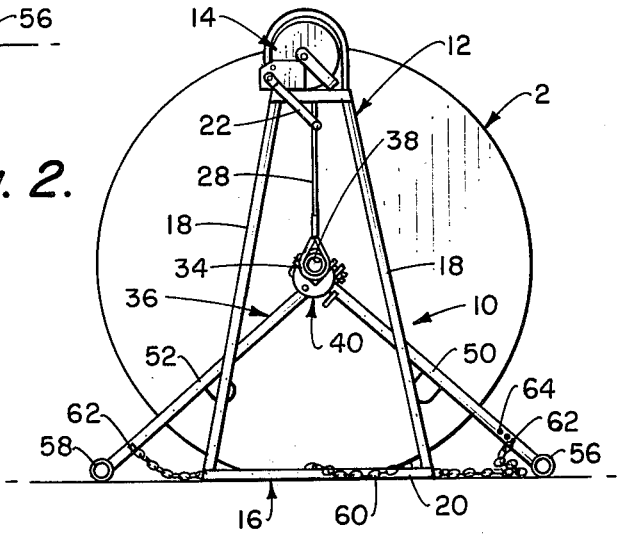
FIG. 2 illustrates the lifting or hoisting mechanism of the invention in place ready to elevate one end of the reel.
Figure 9:
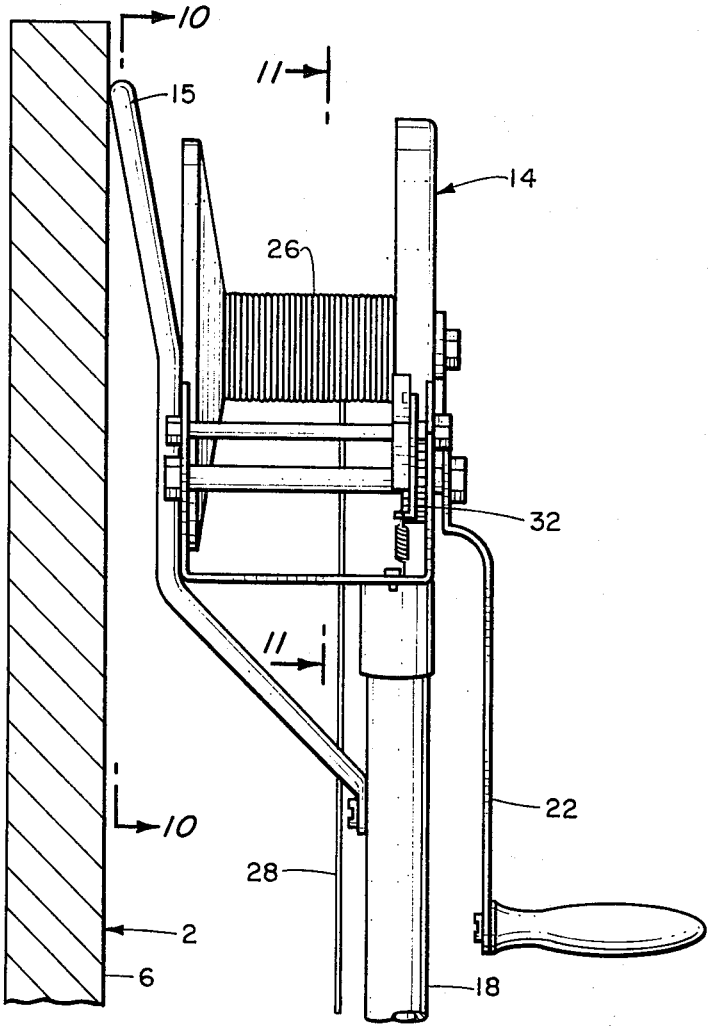
FIG. 9 is a view taken along the line 9—9 of FIG. 3.
Figure 10:
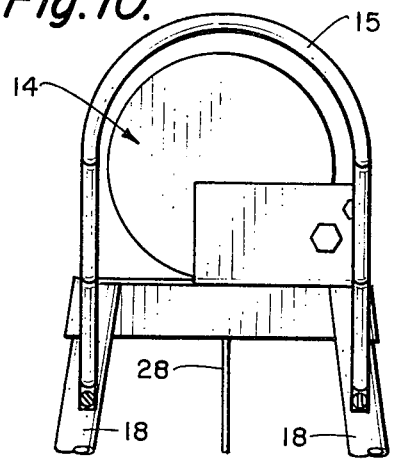
FIG. 10 is a view taken along the line 10—10 of FIG. 9.
Figure 11:
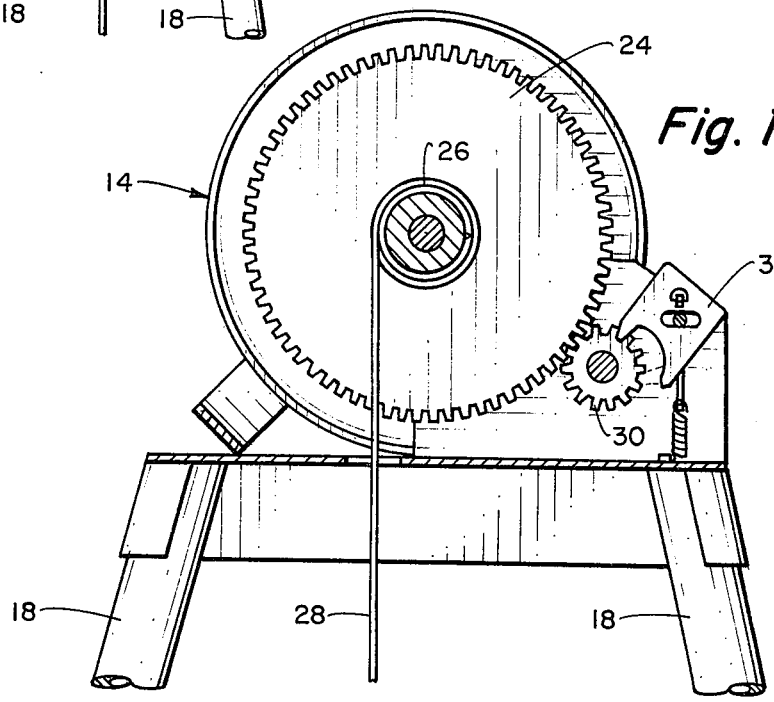
FIG. 11 is a view taken along the line 11—11 of FIG. 9.

The lifting or hoisting mechanism 12 is positioned as shown in FIG. 2 with the loop end 34 of hoist cable 28 looped around pipe 38. One end of the reel is lifted off the ground as shown in FIG. 3 and if the reel is not in satisfactory position for feeding the cable or wire therefrom, the roll bar 15 (FIGS. 9 and 10) provides means whereby application of force on one end of the reel permits arcuate movement of the reel for selective positioning of same as shown in FIG. *3a*. The roll bar 15 provides a pivot point against which the circular ends 4 or 6 of reel 2 may abut against. Once the reel is adequately positioned, the locking chain 60 is locked between the locking fingers 64 so that the duo-pod support member satisfactorily supports one end of the reel in elevation from the ground or floor surface.

Thereafter, the lifting or hoist mechanism 12 is removed from the elevated side of the reel and placed on the opposite side of the reel, the loop 34 engaged in the pipe end 38, the winch handle 22 rotated to raise the other side of the reel to the approximate elevation of the already elevated side and the similar steps performed to assure that the duo-pod support 36 on the opposite side is positioned in the secured, supporting position.

The reel of cable or wire is now in an elevated position to permit easy unwinding of the cable or wire therefrom, since the reel is now able to rotate having been elevated from ground or floor level and by reason of through pipe or other support member 38 providing rotative support for reel 2.

While the invention has been described with regard to specific structure, it will be obvious to those of ordinary skill in the art that certain modifications and changes can be made without departing from the spirit and scope of the invention. For example, while the roll bar 15 has been illustrated as terminating above the winch mechanism hub ends, this need not be so where the reel 2 has circular ends of smaller diameter.

In instances where the reel ends are smaller, the roll bar 15 may be modified appropriately so as to terminate to provide a bearing, pivot point necessary for rotating or moving the reel in an arcuate position for better placement of the cable or wire take off.

Additionally, while a specific retaining or locking means, such as the chain has been illustrated, there are other means which will at once make themselves apparent to those of ordinary skill in the art and such modifications or changes, as well as any other modification and changes, not departing from the spirit and essence of the invention, as disclosed herein, are intended to be covered by the appended claims.

We claim:

1. A reel lift and support for lifting and supporting a reel of cable or the like to permit unwinding of cable or the like therefrom, comprising: means for sequentially lifting one end of said reel for placement of a support member, as hereinafter defined, on each side of said reel; a slideably disposable horizontal support means adapted for use in lifting and supporting said reel and adapted for releasable cooperative association with said reel; a pair of support members for positioning on each side of said reel and adapted to be cooperatively, supportingly and releasably associated with said horizontal support means, said pair of support members, each comprising a support block to receive said horizontal support means in supportive relationship, a first elongate leg member, fixedly secured to said support block and a second, spaced, elongate leg member pivotally secured to said support block for movement towards and away from said first elongate leg member, said first and second elongate leg members lying in the same plane; and retaining means for selectively positioning and retaining said second elongate leg member with respect to said first elongate leg member, whereby said pair of support members support said reel in elevation to permit rotation thereof.

2. The apparatus in accordance with claim 1 wherein said pair of support members comprise a duo-pod structure.

3. The apparatus in accordance with claim 2 wherein said support block comprises a pair of rigidly secured, spaced apart plates, having a V-shaped slot therein and a V-shaped plate is rigidly secured therein.

4. The apparatus in accordance with claim 3 wherein said support block has a length of locking chain secured thereto for locking engagement with said horizontal support means.

5. The apparatus in accordance with claim 4 wherein said locking chain has one end provided with a fastening means and said V-shaped lock has a central slot therein to permit passage therethrough into a retainer for tight securement of said locking chain.

6. The apparatus in accordance with claim 5 wherein said elongate leg members are tubular and have termini for weight distribution.

7. The apparatus in accordance with claim 6 wherein said retaining means for selectively positioning and retaining said second elongate leg member, comprises a length of chain, each end of which is secured to a lower portion of each of said leg members.

8. The apparatus in accordance with claim 7 wherein one of said leg members has a pair of spaced, locking fingers at a lower portion thereof for friction retainment of said length of chain to position said leg members relative to one another in a preselected manner.

9. The apparatus in accordance with claim 8 wherein said pair of support members are collapsible into side-by-side relationship for ease of storage and transportability thereof.

10. A reel support for elevatingly supporting a central bore reel of cable or the like to permit unwinding of cable or the like therefrom, comprising: support means insertable in the central bore of the reel for supporting each end of said reel; a pair of support members for positioning on each side of said reel and adapted to be cooperatively, releasably and supportingly associated with said support means, said pair of support members each comprising a mounting member to receive said support means in supportive, mountive relationship, a first elongate leg member fixedly secured to said mounting member and a second, spaced, elongate leg member pivotally secured to said mounting member for movement towards and away from said first elongate leg member, said first and second elongate leg members lying in the same plane; and retaining means cooperatively associated with said support member for selectively positioning and retaining said second elongate leg member with respect to said first elongate leg member, whereby said pair of support members support said reel in stable elevation to permit rotation thereof, said pair of support members comprising a duo-pod structure and said mounting member comprises a pair of ridigly secured, spaced apart plates, having a V-shaped slot therein and a V-shaped plate is rigidly secured therein.

11. The apparatus in accordance with claim 10 wherein said mounting member has a length of locking chain secured thereto for locking engagement with said horizontal support means.

12. The apparatus in accordance with claim 11 wherein said locking chain has one end provided with a fastening means and said V-shaped plate has a central slot therein to permit passage therethrough into a retainer for tight securement of said locking chain.

13. The apparatus in accordance with claim 12 wherein said elongate leg members are tubular and have termini for weight distribution.

14. The apparatus in accordance with claim 13 wherein said retaining means for selectively positioning and retaining said second elongate leg member, comprises a length of chain, ends of which are secured to a lower portion of each of said leg members.

15. The apparatus in accordance with claim 14 wherein one of said leg members has a pair of spaced, locking fingers at a lower portion thereof for friction retainment of said length of chain to position said leg members relative to one another in a preselected manner.

16. The apparatus in accordance with claim 15 wherein said pair of support members are collapsible into side-by-side relationship for ease of storage and transportability thereof.

* * * * *